219-121 SR
11/3/87 XR 4,703,557

United States Patent [19]
Nespor et al.

[11] Patent Number: 4,703,557
[45] Date of Patent: Nov. 3, 1987

[54] ADJUSTMENT OF THICK FILM RESISTOR (TCR) BY LASER ANNEALING

[75] Inventors: John F. Nespor, Murrysville, Pa.; Robert F. Gornick, Edwardsburg, Mich.; Richard Y. Kwor, South Bend, Ind.

[73] Assignee: CTS Corporation, Elkhart, Ind.

[21] Appl. No.: 916,414

[22] Filed: Oct. 7, 1986

[51] Int. Cl.[4] ..... H01C 17/06
[52] U.S. Cl. ..... 29/620; 219/121 LM; 427/53.1; 427/101
[58] Field of Search ..... 29/620; 427/101, 102, 427/53.1; 219/121 L, 121 LM, 121 LY, 121 LZ

[56] References Cited

U.S. PATENT DOCUMENTS 4,467,519 8/1984 Glang et al. ..... 29/576 B

OTHER PUBLICATIONS

Lins, Stanley J. & Morrison, Dr. Richard D., "Laser-Induced Resistivity Changes in Film Resistors", Defense Systems Div., Univac Div. of Sperry Rand Corp., St. Paul, Minn., presented at Wescon, Los Angeles, Calif., Aug. 23-26, 1966.
Veeraraghavan, V. G., "In-situ Annealing of Cermet Film" IBM Tech. Disclosure Bulletin, vol. 26, No. 4, Sep. 1983, p. 1950.
Lever, R. F., "Background Heating for Laser Annealing" IBM Tech. Disclosure Bulletin, vol. 21, No. 10, Mar. 1979, p. 4040.

*Primary Examiner*—P. W. Echols
*Attorney, Agent, or Firm*—Rodger H. Flagg

[57] ABSTRACT

The adjustment of the temperature coefficient of resistance (TCR) of a thick film resistor by laser annealing is disclosed. The thick film resistor is fired for a controlled time and temperature sufficient to burn off the organic material in the resistive paint, and to provide an initial adjustment of the (TCR), but prior to obtaining the desired (TCR) range. The resistor is then laser annealed to controllably adjust the (TCR) of the resistor within the desired (TCR) range. The fixture used to hold the substrate during laser annealing is preferably controllably heated to avoid thermal shock to the resistor during laser annealing. A microprocessor is preferably used to monitor the (TCR) during the laser annealing process. At least one of the laser scan speed, laser beam diameter, laser beam power, and number of annealing passes are used to controllably adjust the resistor (TCR) to within the desired (TCR) range.

20 Claims, 7 Drawing Figures

ADJUSTMENT OF THICK FILM RESISTOR (TCR) BY LASER ANNEALING

TECHNICAL FIELD

This invention relates to thick film resistors for use in electrical circuitry and apparatus. More particularly, this invention relates to the adjustment of the temperature coefficient of resistance (TCR) of a thick film resistor after firing by annealing the thick film resistor with a laser beam while monitoring the resistor to favorably control and adjust the (TCR) of the annealed thick film resistor.

BACKGROUND ART

Thin film technology typically employs vacuum deposition, sputtering or chemical vapor deposition (CVD) in a vacuum chamber to deposit a conductive or resistive film upon a substrate. Thin film deposition thickness ranges from about 100 to 5,000 angstroms.

Thick film technology differs from thin film technology in many ways. Typically, thick film technology combines a conductor or semiconductor, glass and a screening agent to form a resistive or conductive paint. The mixture is screened or dipped onto a substrate and fired at a temperature higher than the melting point of the glass to bond the mixture to the substrate.

The screening agent is typically burned off during the firing process. Noble metal thick film resistors are typically fired in air. Base metal thick film resistors are typically fired in an inert atmosphere in order to control oxidation during the firing process.

Thick film resistor paint thickness ranges from about 10 to 40 microns, or about 100 times thicker than thin film resistors.

Thick film resistor (TCR) has been typically adjusted by varying the chemical composition of the resistor prior to firing. Many factors influence the resulting change in (TCR), including at least in part: chemical properties, consistency of blend, impurities, and the thickness of the applied resistor paint. Some additional factors include firing time and temperature, out-gassing and oxidation of the resistor paint during firing, and the number of firings. The combustion products, produced during firing, can have a detrimental effect on the properties of the resistor, if they are not removed.

The (TCR) of a specific thick film resistor composition is very sensitive to firing time and temperature.

Thick film resistors are often fired in an oven having several temperature control chambers, with the firing time in each chamber dependent upon chamber size and the speed of the belt passing through the oven, upon which the thick film resistor is placed. These ovens are sometimes equipped with a means to limit the oxygen content within at least a portion of the oven to inhibit oxidation of the resistive paint during firing.

It has not been practical to monitor the (TCR) of a thick film resistor network during firing in such ovens on a commercial basis, nor to adjust the firing time or temperature in response to the change in (TCR) of the resistor during firing.

Laser trimming has been used to cut away a portion of the resistive material to obtain a desired resistor geometry, but laser trimming does not greatly affect the (TCR) of the remaining resistor network.

Thermal trimming of thin film resistors is known, as disclosed in U.S. Pat. No. 3,420,706, and in an article published in Thin Solid Films, 125 (1985) pages 53 56 entitled: "Effect of Annealing on the Electrical Resistance of Thin Films of Alkaline Earth Metals" by P. Renucci, L. Gaudart, J. P. Petrakian and D. Roux.

An article by C. W. White and P. S. Percy, entitled: "Laser and Electron Beam processing of Materials," page 28, published by the Academic Press in 1980 provides useful background information.

Also noted is an article by A. Gat and J. F. Gibbons, "A Laser-Scanning Apparatus for Annealing of ion Implantation Damage in Semiconductors," Applied Physics Letters 32, No. 3 (1978).

DISCLOSURE OF THE INVENTION

This invention relates to the adjustment of the temperature coefficient of resistance (TCR) of thick film resistors by first firing the thick film resistors for a controlled time and temperature, sufficient to burn off the organic material in the resistive paint, but prior to achieving the desired (TCR) range. Then annealing the thick film resistor with a laser beam while monitoring the resistor network to favorably adjust the thick film resistor (TCR) within the desired (TCR) range.

The features and objects of this invention and the manner of attaining them will be best understood by reference to the following description of an embodiment of the invention, when considered in conjunction with the accompanying drawings.

BEST MODE FOR CARRYING OUT THE INVENTION

Figure 1:
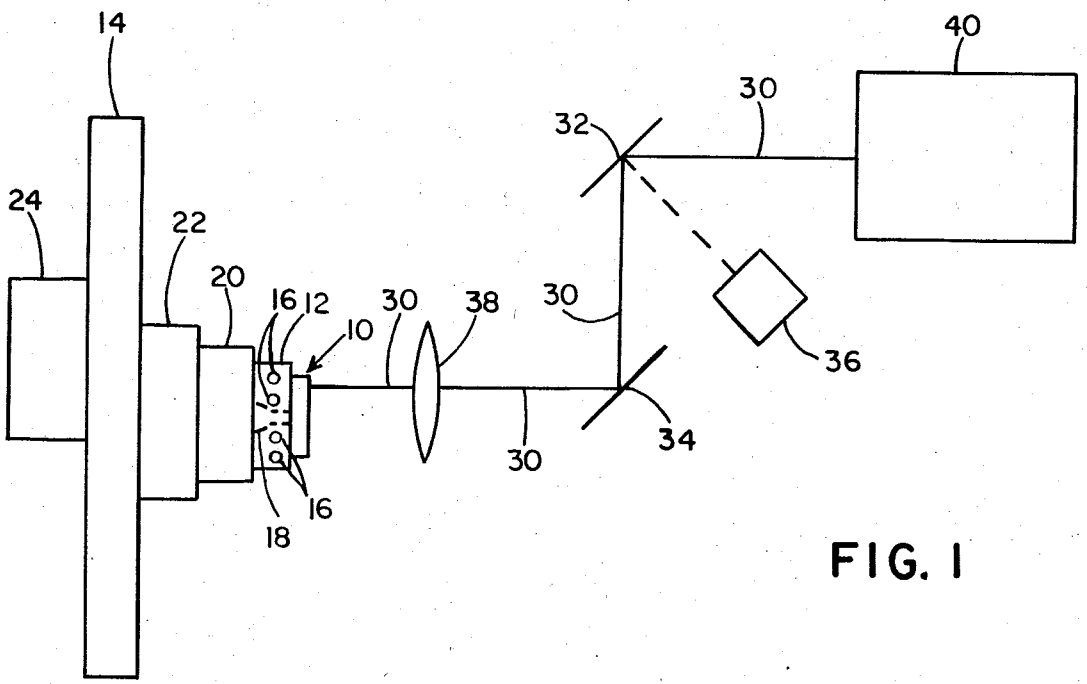
FIG. 1 is a diagram of an embodiment of the laser scanning system.

The subject matter which we regard as our invention is particularly pointed out and distinctly claimed in the claims. The structure and operation of our invention, together with further objects and advantages, may be better understood from the following description given in connection with the accompanying drawings, in which:

FIG. 1 shows a thick film resistor network 10, releasably secured to a fixture 12 mounted upon a base 14. Fixture 12 may be adapted with heating elements 16, such as NiCr tube heating elements, to sufficiently heat the fixture to avoid thermal shock to the thick film resistor network 10 during the laser annealing process. The heating elements 16 may be adapted to controllably heat the resistor network from 200° C. to 600° C., and preferably within 300° C. ±50° C.

A vacuum force (not shown) may be employed through a plurality of apertures 18 in fixture 12 to releasably secure the resistor network 10 to fixture 12. An insulator 20 may be disposed between the fixture 12 and the base 14 to limit thermal conductivity from fixture 12 to base 14. Alternately, fixture 12 may be secured to base 14 in spaced relation, allowing air to pass between fixture 12 and base 14 to limit heat transfer from the fixture 12 to base 14. A cooling block 22 may also be employed between fixture 12 and base 14 for the same purpose. Cooling block 22 may employ any conventional cooling means, to transfer heat away from base 14.

Base 14 or fixture 12 may be adapted for movement in an X or Y translating stage to move resistor network 10 in relation to a laser beam 30. Alternatively, laser 40 may be adapted for movement in an X or Y translating stage while resistor network 10 remains stationary upon fixture 12. One or more scanning mirrors may also be used to move the laser beam in relation to the resistor. A stepping motor 24 may be employed to move base 14 or fixture 12 in either an X or Y translating mode. It is within the scope of the art to use other conventional means to move the resistor network 10 in relation to the laser beam 30 in a manner to provide an annealing pass along the thick film resistive pattern disposed upon the resistor network 10.

Precise control of movement between resistor 10 and laser beam 30 during the laser beam scan provides a means to laser anneal a single resistive circuit path 28 on resistor network 10, to enable precise adjustment of the resistor 10 (TCR). Multiple resistive circuit paths 28 may also be scanned, or the entire surface of resistor 10 may be scanned to favorably adjust the resistor 10 (TCR).

As shown in FIG. 1, laser 40 may be any conventional laser source, such as an Ar ion laser, YAG laser, or $CO_2$ laser suitable for annealing the resistor network, as herein disclosed. Preferably the laser is a continuous wave laser. Laser beam 30 may be directed by one or more reflecting mirrors, such as shutter mirror 32 and scanning mirror 34. A focussing lens 38 may be used to control the laser beam 30 diameter in proximity to the resistor surface. A power meter 36 may be positioned along laser beam 30 to monitor laser beam power during the laser annealing process.

Figure 2:
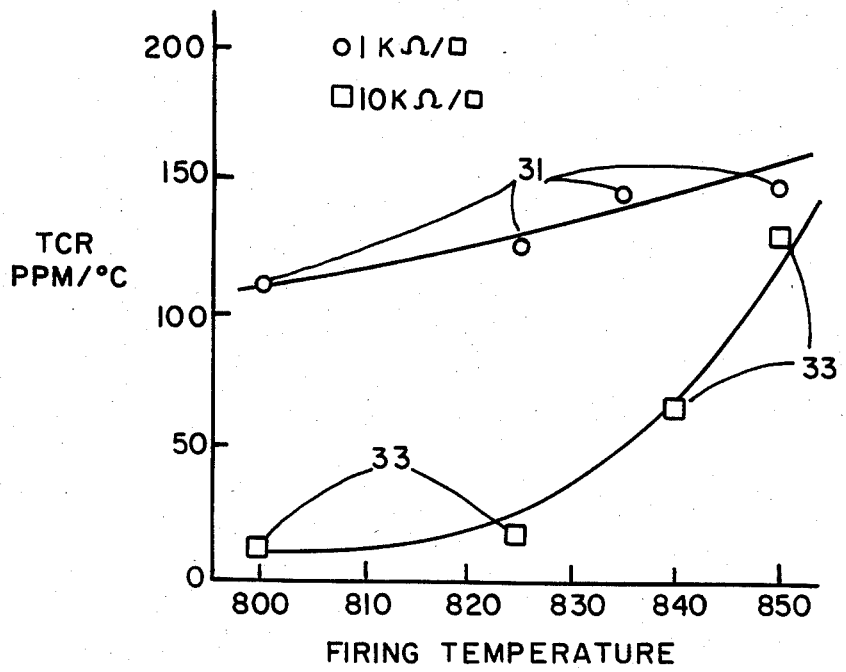
FIG. 2 is a graph showing the effect of firing temperature on the (TCR) of two thick film resistors.

Referring now to FIG. 2, the graph shows the effect of firing temperature on the (TCR) of two different $RuO_2$ thick film resistor networks. Round symbols 31 are used to show the change in (TCR) in parts per million per degree centigrade (ppm/° C.) of a resistor network having 1000 ohms per square. As shown in FIG. 2, the (TCR) increased from just above 100 ppm/° C. at 800° C. firing temperature to more than 150 ppm/° C. at a firing temperature of 850° C.

Square symbols 33 show the effect of firing temperature on (TCR) of a 10,000 ohm per square thick film resistor network. At 800° C., the (TCR) of the 10K ohm per square resistor was approximately 10 ppm/° C.; and at a firing temperature of 850° C., the (TCR) was increased to approximately 140 ppm/° C.

Most thick film resistive elements are in a non-equilibrium state and therefore sensitive to temperature change. Both hot and cold temperature coefficents of resistance (HTCR and CTCR) are known to the art. Ideally, a thick film resistor network would have a (HTCR and CTCR) within a desired (TCR) range. (TCR) tolerances of ±200 are now possible in production, with (TCR) tolerances of ±100 becoming increasingly desirable. Consistent (TCR) values of less than ±100 are extremely difficult to obtain in production quantities where the (TCR) is controlled by adjusting the chemical properties of the resistive paint prior to firing.

The present invention solves these problems by annealing the resistor after firing with a laser beam to favorably adjust the (TCR) within a desired (TCR) range, usually less than ±100 ppm/° C. This is accomplished by monitoring the resistor during the annealing process, and by adjusting at least one of the following parameters to control and favorably adjust the (TCR) of the annealed resistor: the laser scan speed; the laser beam diameter; the laser beam power; and the number of annealing passes.

Figure 3:
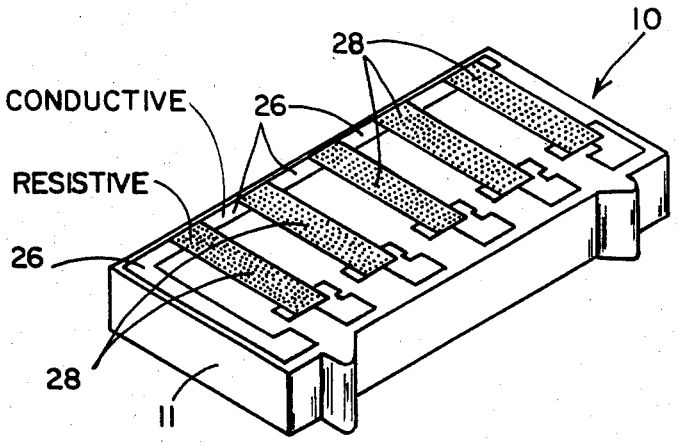
FIG. 3 is a perspective view of an embodiment of a thick film resistor network.

FIG. 3 is a perspective view of a typical resistor network 10, having a plurality of conductive 26 and resistive 28 circuit paths fired upon substrate 11.

Figure 4A:
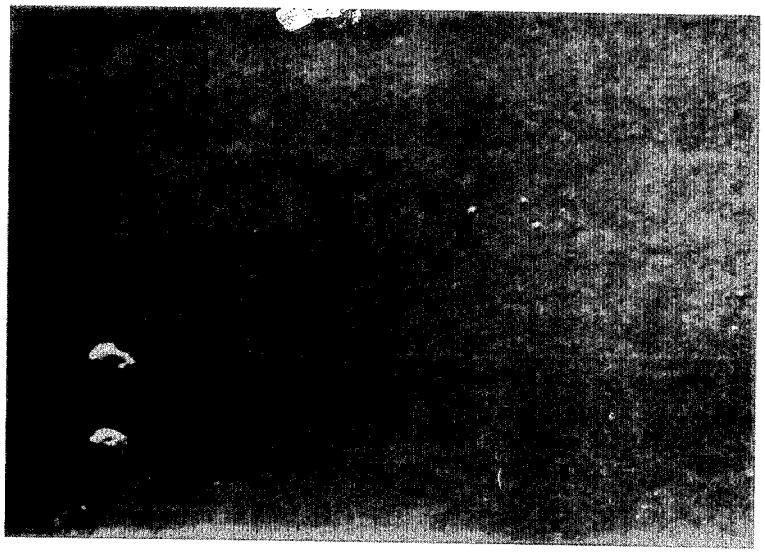
FIG. 4A is an enlarged photographic representation of the surface of a thick film resistor as fired.

FIG. 4A shows an enlarged photographic view of the surface of a thick film resistor after firing. The two bumps shown in the lower left hand corner are dust particles.

Figure 4B:
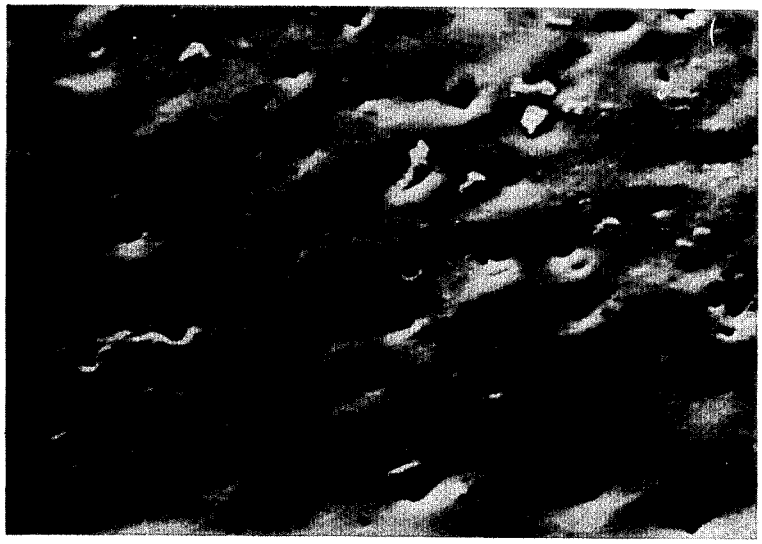
FIG. 4B is an enlarged photographic representation of the surface of a thick film resistor showing damage from high intensity laser annealing.

FIG. 4B is an enlarged photographic view of the surface of a thick film resistor showing extensive damage caused by use of a high intensity laser beam. Laser annealing as taught by this invention will not cause damage to the resistor network, as shown in FIG. 4B.

An Ar ion laser has a wave length of $\lambda=514$ nanometers. At this intensity, the radiation from the Ar ion laser will not be absorbed by most substrates or glass, while the radiation will be readily absorbed by the semiconductor portion of the resistive element. A $CO_2$ laser has a wave length of $\lambda=10.6$ microns, which is sufficient to heat up most substrates and glass, as well as the resistive element making faster scanning speeds practical. A YAG laser has a wave length of $\lambda=1.06$ microns, which falls between the wave lengths of Ar ion and $CO_2$ lasers.

Depending upon the wave length of the laser selected, care must be taken to control the annealing process to avoid the damage from high-intensity annealing shown in FIG. 4B. By controlling one or more of the following variables, most resistor networks may be successfully annealed: laser scan speed, laser beam diameter, laser beam intensity, and the number of annealing passes. A continuous wave (CW) laser is preferred to avoid the thermal spikes caused by a pulsed wave laser system. Other lasers may be adapted for laser annealing as disclosed in this specification by controlling one or more variables referenced above.

It is preferred to raise the surface temperature of the resistive element to a temperature close to the strain temperature of the thick film glass to prevent stresses which may create an unstable resistor during the laser annealing process. A high substrate temperature also reduces the laser power required to cause a positive change in resistor (TCR).

During the laser annealing process, the laser beam scans the resistor surface, causing an increase in the temperature of the resistive material, which in turn alters the micro-structure of the resistor. If the laser radiation is too intense, damage to the micro-structure can occur, creating an unstable resistor. Therefore, the laser annealing process must be well controlled to provide consistent results.

Figure 5:
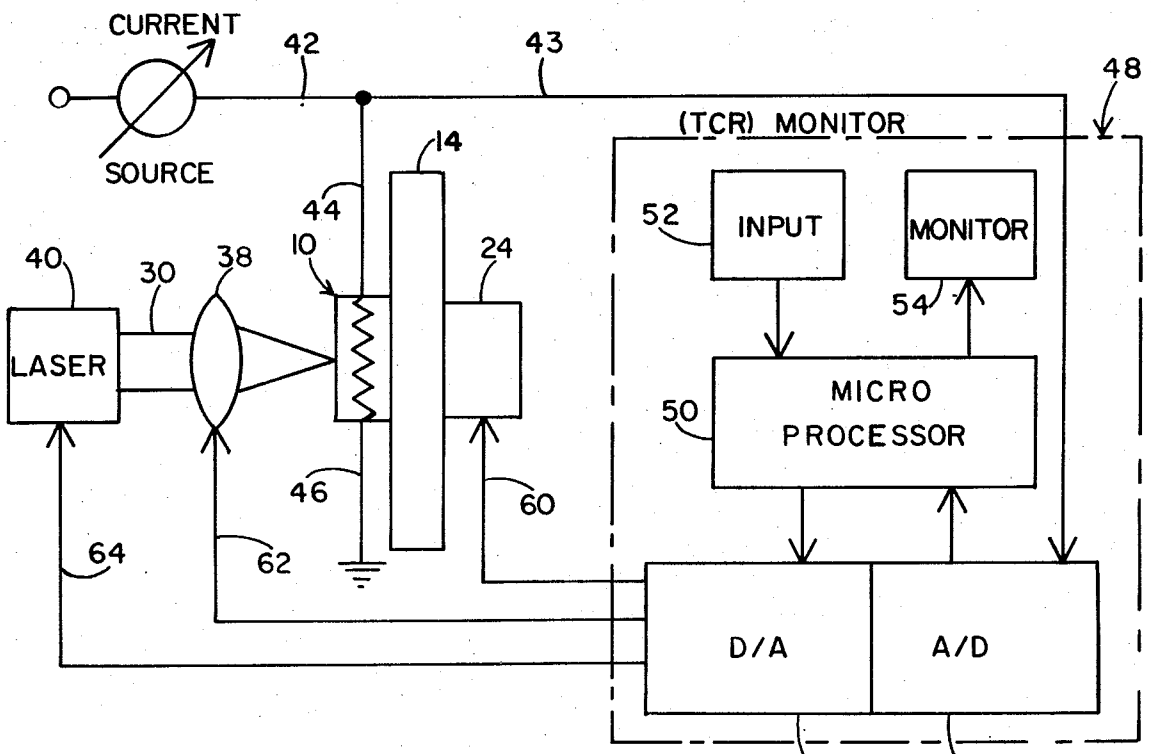
FIG. 5 is a diagram showing an embodiment of the (TCR) monitoring and control system.

Referring now to FIG. 5, the fired resistor 10 is releasably secured to base 14, preferably with a fixture 12 as shown in FIG. 1.

Base 14 may be movably positioned in relation to laser 40 with a stepping motor 24, or other positioning device. Alternatively, laser 40 or laser beam 30 may be movably positioned in relation to base 14. Laser beam 30 preferably passes through a focussing lens 38, which may be movably positioned to adjust the laser beam diameter in proximity to the resistor 10 surface.

A current source passes along line 42 to resistor network 10 along line 44, passing through the resistor network 10 to ground 46. The change in the resulting signal voltage passes along line 43 to (TCR) monitor 48. The (TCR) laser annealing monitor preferably comprises an analog-to-digital (A/D) converter 56 and a digital-to-analog (D/A) converter 58; a microprocessor 50; and an input means 52, such as a keyboard; and a monitor means 54, such as a computer monitor.

The signal voltage preferably passes along line 43 to (A/D). The digital output from the (A/D) then passes to microprocessor 50. The monitor signal is preferably observed on a monitor 54, and manual input to microprocessor 50 may be initiated from input 52.

Microprocessor 50 is preferably programmed to control at least one of the variables affecting the laser annealing process. These variables preferably include laser beam speed, laser beam diameter, laser beam intensity, and the number of annealing passes.

Control signals may pass through a (D/A) converter where analog control signals are preferred. Where digital control signals are preferred, they may also be utilized directly from the microprocessor. Control signal 60 passes to stepping motor 24, to adjustably position the resistor network in relation to the laser beam 30. Control signal 62 may be used to controllably adjust focusing lens 38 to control the laser beam diameter at resistor network 10. Control signal 64 may be used to control laser beam power.

Figure 6:
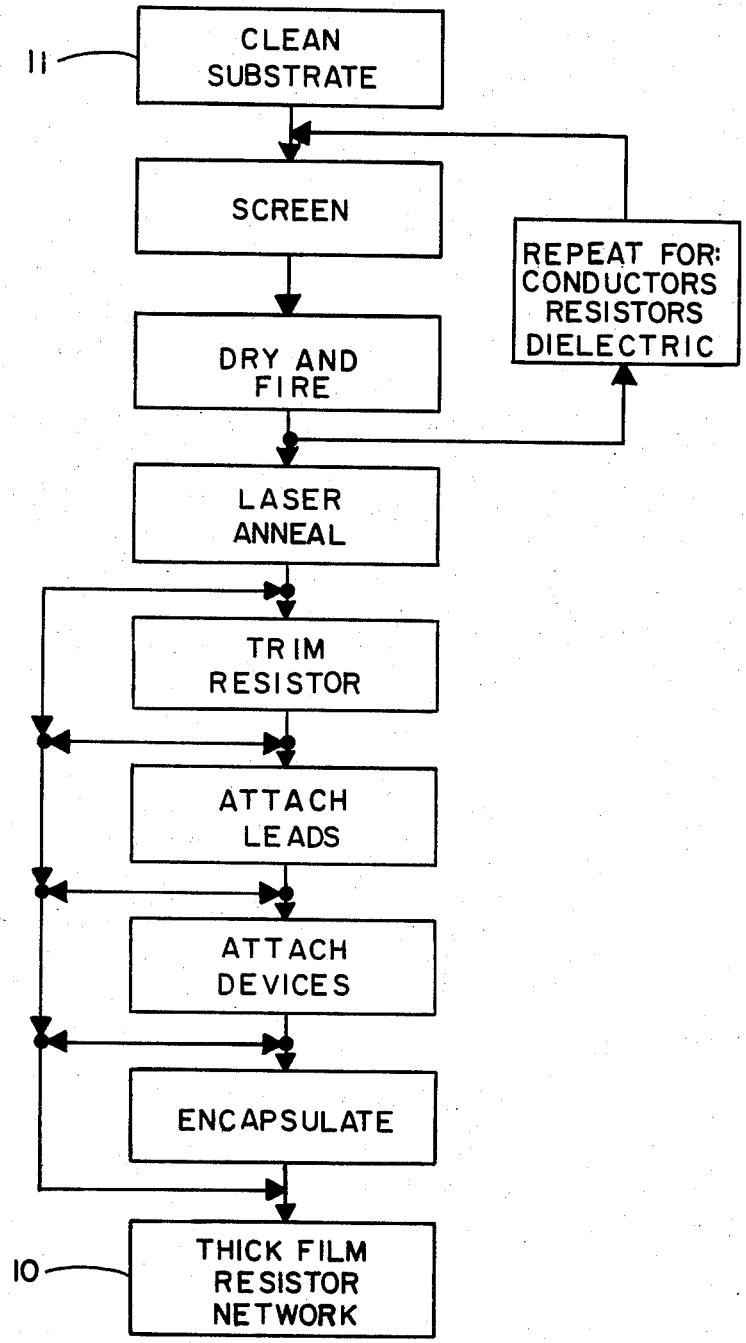
FIG. 6 is a flow chart showing the preferred manufacturing process steps of a thick film resistor adapted for laser annealing.

Referring now to FIG. 6, a preferred process for thick film resistor networks 10 is disclosed. Substrate 11 is cleaned, then the resistive, conductive or dielectric patterns are screened upon the substate 11. After screening, the resistor network is dried and fired. This process may be repeated as required to complete the resistor network.

After firing, the resistor 10 passes through the laser annealing process to favorably adjust the (TCR) of the resistor network. After annealing one or more of the following steps may be added:

The resistor may be trimmed using any conventional means, such as laser trimming. Leads may be attached as required by any conventional means, and other devices may also be attached as required to complete the resistor network 10.

The resistor network may then be encapsulated to protect the circuitry from external environmental conditions. As shown in FIG. 6 by opposing arrows, the laser trim, attach leads, attach devices, and encapsulation steps may be taken in any desired order following the firing and laser anneal steps.

Initial tests were conducted using an Ar ion continuous wave laser, model Innova 20, with a maximum power of 21 watts. The laser scanning speed was set at the slowest possible scanning speed, as a faster scanning speed was found to decrease the effective laser intensity. Faster laser scanning speed is believed useful where larger wave length lasers, such as a $CO_2$ or YAG continuous wave lasers are to be used.

The laser beam intensity at resistor 10 increased by decreasing the distance between the resistor 10 and the focusing lens 38. The laser beam intensity at resistor 10 was decreased by increasing the distance between the resistor 10 and the focusing lens 38. See Table I below:

TABLE I

The effect of laser beam diameter (distance from the focal point) on (TCRs) and stability of annealed thick film resistors.

| Distance From Focal Pt. (in.) | Avg. (TCR) PPM/°C. +125° C. | Max. (TCR) PPM/°C. +125° C. | Min. (TCR) PPM/°C. +125° C. | Max. Thermal Stability % ΔR |
|---|---|---|---|---|
| 1.8 | 67 | 86 | 43 | .097 |
| 1.6 | 39 | 49 | 32 | .082 |
| 1.4 | 32 | 61 | 2 | .411 |
| 1.2 | −10 | 42 | −37 | .932 |
| 1.0 | −108 | −199 | −46 | 1.564 |
| .75 | LASER DAMAGE TO SURFACE | | | |
| AS FIRED | 84 | 86 | 81 | .030 |

The (TCR) of resistor 10 was lowered by laser annealing when the initial (TCR) was negative. The (TCR) was increased by laser annealing when the initial (TCR) was positive. Since the desired ideal (TCR) range is less than ±100 ppm/°C., it is preferred to begin the laser annealing process with a resistor having a negative (TCR).

During the laser annealing tests, it was found that one scan of the laser did not achieve best results. Use of lower laser beam intensity and several laser scans produced the best results. There was also less opportunity for damaging the resistors during the laser annealing process. Table II shows the effect of multiple laser scans on the stability of the thick film resistors tested.

TABLE II

The effect of multiple annealings on the (TCRs) and stability of thick film resistors.

| No. of Anneals | Avg. (TCR) PPM/°C. +125° C. | Max. (TCR) PPM/°C. +125° C. | Min. (TCR) PPM/°C. +125° C. | Max. Thermal Stability % ΔR |
|---|---|---|---|---|
| 1 | −116 | −128 | −109 | −.015 |
| 2 | −80 | −78 | −84 | +.016 |
| 3 | −90 | −100 | −75 | +.446 |
| 4 | −74 | −128 | −39 | +.283 |
| 6 | −102 | −150 | −30 | +1.019 |
| 8 | −140 | −214 | −70 | +.227 |
| AS FIRED | −148 | −151 | −143 | −.017 |

The effect of laser power on resistor (TCR) and thermal stability of annealed thick film resistors is shown in Table III below:

TABLE III

The effect of laser power on the (TCRs) and stability of annealed thick film resistors.

| Laser Power Watts | Avg. (TCR) PPM/°C. +125° C. | Max. (TCR) PPM/°C. +125° C. | Min. (TCR) PPM/°C. +125° C. | Max. Thermal Stability % ΔR |
|---|---|---|---|---|
| 10 | 68 | 72 | 63 | .007 |
| 17 | 78 | 81 | 66 | −.075 |
| 21 | −108 | −199 | −46 | −1.564 |
| AS FIRED | 84 | 86 | 81 | .03 |

Table IV shows a summary of (TCR) data comparing resistors as fired, with subsequent laser annealing.

TABLE IV

Summary of the (TCR) data of annealed thick film resistors.

| RES KΩ/□ | Laser Power Watts | Avg. (TCR) PPM/°C. +125° C. | Max. (TCR) PPM/°C. +125° C. | Min. (TCR) PPM/°C. +125° C. | Max. Thermal Stability % ΔR |
|---|---|---|---|---|---|
| 1 | LASER ANNEALED | −15 | −23 | −2 | .016 |
| 1 | AS FIRED | −29 | −133 | −123 | .010 |
| 10 | LASER ANNEALED | −80 | −84 | −78 | .016 |
| 10 | AS FIRED | −148 | −151 | −143 | −.018 |

Based upon these test results, it is apparent that the (TCR) of a resistor network 10 may be favorably adjusted by laser annealing the resistor after an initial firing. The initial firing provides a macro adjustment of the resistor network (TCR), while providing for outgassing during the burn-off of the screening agent from the thick film resistor paint. The initial firing also inhibits oxidation during the initial firing of base metal resistors, through the introduction of an inert atmosphere during the initial firing as currently practiced in the art. Preferably the initial firing is stopped before the desired (TCR) range is reached and preferably while the (TCR) is negative. Laser annealing as herein disclosed, is then used to provide a micro adjustment of the thick film resistor (TCR) to favorably adjust the (TCR) within the desired (TCR) range.

In this manner, thick film resistor network 10 may be consistently manufactured in commercial quantities, with an adjusted (TCR) of less than ±100 ppm/°C. By controlling the micro adjustment of the thick film resistor (TCR) through laser annealing, as herein disclosed, the (TCR) may even be adjusted to within ±50 (TCR), satisfying even the most stringent fabrication requirements.

Therefore, while this invention has been described with reference to a particular embodiment, it is understood that modifications may be made without departing from the spirit of the invention, or from the scope of the following claims.

INDUSTRIAL APPLICABILITY

This invention discloses a process for adjusting the (TCR) of thick film resistor networks by laser annealing the resistor after firing, to favorably adjust the (TCR) of the resistor. This process provides thick film resistor networks capable of meeting the most stringent (TCR) requirements for electronic circuitry.

We claim:

1. A method for controllably adjusting the (TCR) of a non-equilibrium thick film resistor, having a resistive paint disposed upon a substrate, which comprises:

(a) firing the resistive paint for a time and temperature sufficient to burn off the organic material in the resistive paint, and prior to obtaining the desired (TCR) range;

(b) releasably securing the fired resistor upon a fixture;

(c) laser annealing the fired resistor by movably positioning one of a laser beam and the resistor in relation to the other to complete a laser annealing pass;

(d) controllably adjusting at least one of a laser scan speed; laser beam diameter; laser beam power; and number of annealing passes to controllably adjust the (TCR) of the resistor within the desired (TCR) range.

2. The method of claim 1, wherein the fixture is controllably heated in a range from 200° C. to 600° C. to reduce thermal shock in the resistor during laser annealing.

3. The method of claim 2, wherein the fixture is heated to 300° C.±50° C. during laser annealing.

4. The method of claim 1, wherein a microprocessor is adapted to monitor the effect of laser annealing upon the resistor (TCR), and to controllably adjust at least one of the laser scan speed, laser beam diameter, laser beam power and number of annealing passes to controllably adjust the (TCR) of the resistor to within the desired TCR range.

5. The method of claim 1, wherein the laser beam is generated by a continuous wave laser.

6. The method of claim 1, wherein a focusing lens is disposed across the laser beam path and adapted to controllably adjust the laser beam diameter in proximity to the resistor surface.

7. The method of claim 1, wherein the fired resistor is releasably secured to the fixture with a vacuum force applied through a plurality of apertures in the fixture adjacent to the resistor.

8. The method of claim 1, wherein the fixture is secured to a base, and an insulator is disposed between the fixture and the base to limit thermal conductivity between the fixture and the base.

9. The method of claim 1, wherein the fixture is secured to a base and a cooling block is disposed between the fixture and the base to limit thermal conductivity between the fixture and the base.

10. A process for controllably adjusting the (TCR) of a resistor, which comprises:

(a) applying a thick film resistive paint upon a substrate;

(b) drying and firing the resistive paint and the substrate for a time and temperature sufficient to burn off the organic materials in the resistive paint, and prior to achieving the desired (TCR) range;

(c) releasably securing the fired resistor upon a fixture;

(d) controllably heating the fixture up to 600° C. to reduce thermal shock in the resistor;

(e) laser annealing the fired resistor by movably positioning one of the resistor and a laser beam to complete a laser annealing pass;

(f) controllably adjusting at least one of a laser beam scan speed; laser beam diameter; laser beam power; and the number of annealing passes to controllably adjust the (TCR) of the resistor within the desired (TCR) range; and (g) removing the resistor from the fixture following the laser annealing step.

11. The process of claim 10, wherein the fixture is preferably heated to 300° C. ±50° C. to reduce thermal shock to the resistor during the laser annealing process.

12. The process of claim 10, wherein a microprocessor is adapted to monitor the effect of the laser annealing process upon the resistor, and to controllably adjust at least one of the laser scan speed, the laser beam diameter, the laser beam intensity and the number of annealing passes to controllably adjust the (TCR) of the resistor within the desired (TCR) range.

13. The process of claim 10, wherein a focusing lens is disposed across the laser beam path and adapted to controllably adjust the laser beam diameter in proximity to the resistor surface.

14. The process of claim 10, wherein the fired resistor is releasably secured to the fixture with a vacuum force applied through a plurality of apertures in the fixture adjacent to the resistor.

15. The process of claim 10, wherein the fixture is secured to a base, and an insulating means is disposed between the fixture and the base to limit thermal conductivity between the fixture and the base.

16. A method for adjusting the (TCR) of a non-equilibrium, thick film resistor, having a resistive paint disposed upon a substrate, which comprises:

(a) firing the resistive paint upon the substrate for a time and temperature sufficient to burn off the organic material in the resistive paint, and prior to obtaining the desired (TCR) range;

(b) releasably securing the fired resistor upon a fixture;

(c) laser annealing the fired resistor by controllably moving at least one of a continuous wave laser beam and the resistor in relation to the other in a manner to complete a laser annealing pass;

(d) monitoring the resistor to determine the effect of laser annealing upon the resistor (TCR); and (e) controllably adjusting at least one of the laser scan speed; laser beam diameters; laser beam power; and number of annealing passes to controllably adjust the (TCR) of the resistor within the desired (TCR) range.

17. The method of claim 16, wherein the fixture is controllably heated in a range from 200° C. to 600° C. to reduce the thermal shock to the resistor during laser annealing.

18. The method of claim 16, wherein a microprocessor is adapted to controllably adjust at least one of a laser scan speed; laser beam diameter; laser beam power, and the number of annealing passes in response to the monitoring of the resistor during the laser annealing step to controllably adjust the (TCR) of the resistor within the desired TCR range.

19. The process of claim 16, wherein a focusing lens is disposed across the laser beam path and adapted to controllably adjust the laser beam diameter in proximity to the resistor surface.

20. The process of claim 16, wherein the fixture is secured to a base, and an insulating means is disposed between the fixture and the base to limit thermal conductivity between the fixture and the base.

* * * * *